US006453643B1

(12) United States Patent
Buscherini et al.

(10) Patent No.: US 6,453,643 B1
(45) Date of Patent: Sep. 24, 2002

(54) METHOD AND APPARATUS FOR THE FASTENING OF THE TAIL OF WRAPPINGS OF STRETCHABLE FILM FOR PALLETIZED LOADS

(75) Inventors: Roberto Buscherini, Cesena (IT); Davide Fantini, Cesena (IT)

(73) Assignee: Pieri S.r.l., Pievesestina di Cesena (IT)

( * ) Notice: Subject to any disclaimer, the term of this patent is extended or adjusted under 35 U.S.C. 154(b) by 0 days.

(21) Appl. No.: 09/581,016

(22) PCT Filed: Dec. 4, 1998

(86) PCT No.: PCT/EP98/07892

§ 371 (c)(1),
(2), (4) Date: Jun. 8, 2000

(87) PCT Pub. No.: WO99/29573

PCT Pub. Date: Jun. 17, 1999

(30) Foreign Application Priority Data

Dec. 10, 1997 (IT) ..... BO97A0713

(51) Int. Cl.[7] ..... B65B 13/02

(52) U.S. Cl. ..... 53/399; 53/441; 53/556; 53/587; 53/588

(58) Field of Search ..... 53/399, 416, 441, 53/138.1, 587, 588, 556, 210, 211

(56) References Cited

U.S. PATENT DOCUMENTS

| | | | | |
|---|---|---|---|---|
| 4,235,062 A | * | 11/1980 | Lancaster et al. | 53/399 |
| 4,432,185 A | * | 2/1984 | Geisinger | 53/138.2 |
| 5,452,566 A | * | 9/1995 | Benhamou et al. | 53/389.3 |
| 5,564,258 A | * | 10/1996 | Jones et al. | 53/399 |
| 5,720,153 A | * | 2/1998 | Martin-Cocher | 206/598 |

* cited by examiner

*Primary Examiner*—Rinaldi I. Rada
*Assistant Examiner*—Thanh K. Truong
(74) *Attorney, Agent, or Firm*—Larson & Taylor PLC

(57) ABSTRACT

In wrapping palletized loads with stretchable film having an elastic memory, when the wrapping is about completed, a distancing device is placed close to the wrapped load on which the last wrapping turn rests, so that a pocket is formed in the turn. The carriage of the wrapping machine is stopped in a predetermined angular position and the film tail is aligned and placed in a main clamp and a secondary clamp. Subsequently, a cutting device cuts the film between the two clamps, and the main clamp holding the leading end coming from the wrapping machine carriage moves backward at rest. The other clamp holding the tail end is introduced into the pocket and then opens and is drawn out from the pocket together with the distancing device , so that the wrapping tail gets caught and blocked by friction in the last turn which shrinks flat.

19 Claims, 9 Drawing Sheets

METHOD AND APPARATUS FOR THE FASTENING OF THE TAIL OF WRAPPINGS OF STRETCHABLE FILM FOR PALLETIZED LOADS

The invention relates to a method and apparatus for wrapping palletized loads with stretchable film or other elastic and/or plastic material which owing to the elastic memory of the said wrapping film ensures tight wrappings safely securing the load. The invention can be applied to any known wrapping machine, for instance those in which the load is caused to rotate about a vertical axis, or those in which the load is fixed and the wrapping film feeding equipment rotates around the load itself with an alternate vertical motion at the same time, to make sure the load is tightly wrapped all along its height. The latter machines may be either the type wherein the carriage holding the film reel and pre-stretching rollers rotates on a ring with a vertical or horizontal axis that alternatively moves along such axis, or the type wherein the reel and pre-stretching rollers are mounted so as to be able to move vertically onto the upright of an upside-down "L" arm whose upper end can swing around a vertical axis and is supported by a portal structure below which the load to be wrapped is placed.

In these types of equipment the wrapping film leading end is generally held by a fixed clamp placed to the side of the load to be wrapped which opens when the first turns of the wrapping film are overlapped and self-blocked. The wrapping film leading end is so blocked by friction onto the load and into the wrapping itself, which is a solution extremely reliable as well as quick and easy to realize.

Once the wrapping is completed, the film tail is then heat-sealed to the wrapping itself by an external heated plug or by a welder and a counter-welder which is temporarily drawn near the load so as to be then surmounted by the final turns of the wrapping and is then withdrawn on completion of heat-sealing. The heat-sealing of the tail takes some time also because of the cooling that must follow the heating of the material to be heat-sealed and is often a rather difficult operation to be performed owing to the poor consistency of the stretchable film to be heat-sealed. In addition, the final wrapping turns must be arranged in such a way that their consistency and arrangement are suitable for undergoing heatsealing, which implies a rather difficult operation. Moreover, heat-sealing produces harmful gases which are let out in the ambient air.

The invention provides a new method and the related apparatus to fasten the wrapping film tail consisting of:

- placing near one side of the load some means on which the final turn/tums of the wrapping rests/rest transversally so as to form a pocket of the correct size in the wrapping wherein such turns are properly spaced from the load;
- holding the film, in the zone of the wrapping tail, with a main clamp and a secondary clamp, the said two clamps being not far from each other, the secondary clamp being closer to the load;
- cutting the film between two said clamps so as to identify the wrapping tail held by the secondary clamp and the leading end of the subsequent turn held by the main clamp;
- placing the secondary clamp holding the wrapping tail into said pocket and then opening such clamp and removing it from such pocket, such operation being correctly phased with, the removal of the means that formed the pocket, so that the pocket, owing to the elastic memory of the wrapping film, will shrink and spread flatly quickly and the length of the film that formed it will incorporate and firmly hold the wrapping tail with no need for heat-sealing. Thus is the wrapping tail friction-blocked by the wrapping itself.

More detailed features of the method and the related apparatus, described by way of example in a ring wrapping machine, but that can be adapted to any type of wrapping equipment, will be given in the following description of some preferred embodiments in the figures of the attached sheets of drawings, in which.

Figure 1:
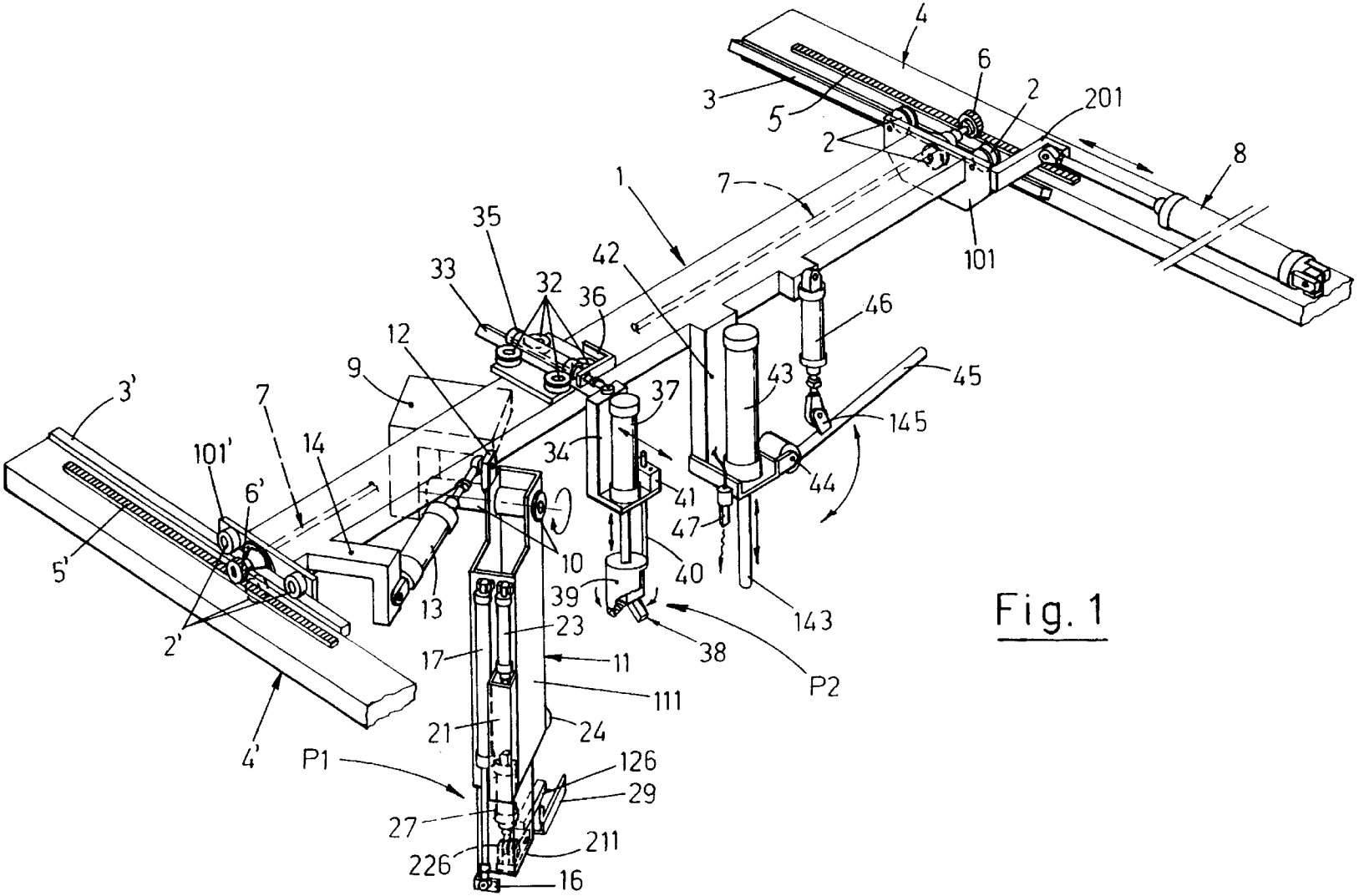
FIG. 1 shows a perspective view of the apparatus with some components at rest and some other components working.

From FIG. 1 it can be seen that the apparatus is mounted to the annular frame (not shown) of a ring-type wrapping machine on which the carriage with the reel and the pre-stretching rollers move, and, for instance, is placed laterally to the path of the load to be wrapped and above the orbit covered by the said carriage. The apparatus is composed of a carrier 1 formed by a horizontal beam parallel to the path of the load to be wrapped and carrying at its end 101–101' the wheels 2–2' partly grooved and partly smooth that run on parallel guide bars 3–3' longitudinally fixed to beams 44 perpendicular to said carrier 1 and fixed to the annular frame on which the carriage with the film reel and pre-stretching rollers runs. Longitudinally fixed to beams 4–4' are racks 5–5' which mesh with pinions 6–6' splined to the ends of a rotating shaft 7 which traverses carrier 1 longitudinally, so that the latter can properly move along said guide bars 3–3' even when operated through one only end, for instance through the linkage between one of its appendixes 201 and the pneumatic cylinder 8 whose body is secured to beam 4.

Fixed underneath carrier 1 in an intermediate position is an upside-down "L" support 9 bearing a horizontal fulcrum pin 10 appropriately converging towards the center line of said carrier 1. Mounted to said pin 10 is the rotating end of a telescopic arm 11 provided with a side appendix 12 projecting from said pin 10 and to which the stem of a pneumatic cylinder 13 is articulated, the body of said cylinder 13 being fulcrum-attached to an arm 14 projecting from carrier 1. Upon operating cylinder 13, arm 11 can move from the vertical position shown in FIG. 1 to a horizontal position, approaching beam 4' (see hereinafter).

Figure 2:
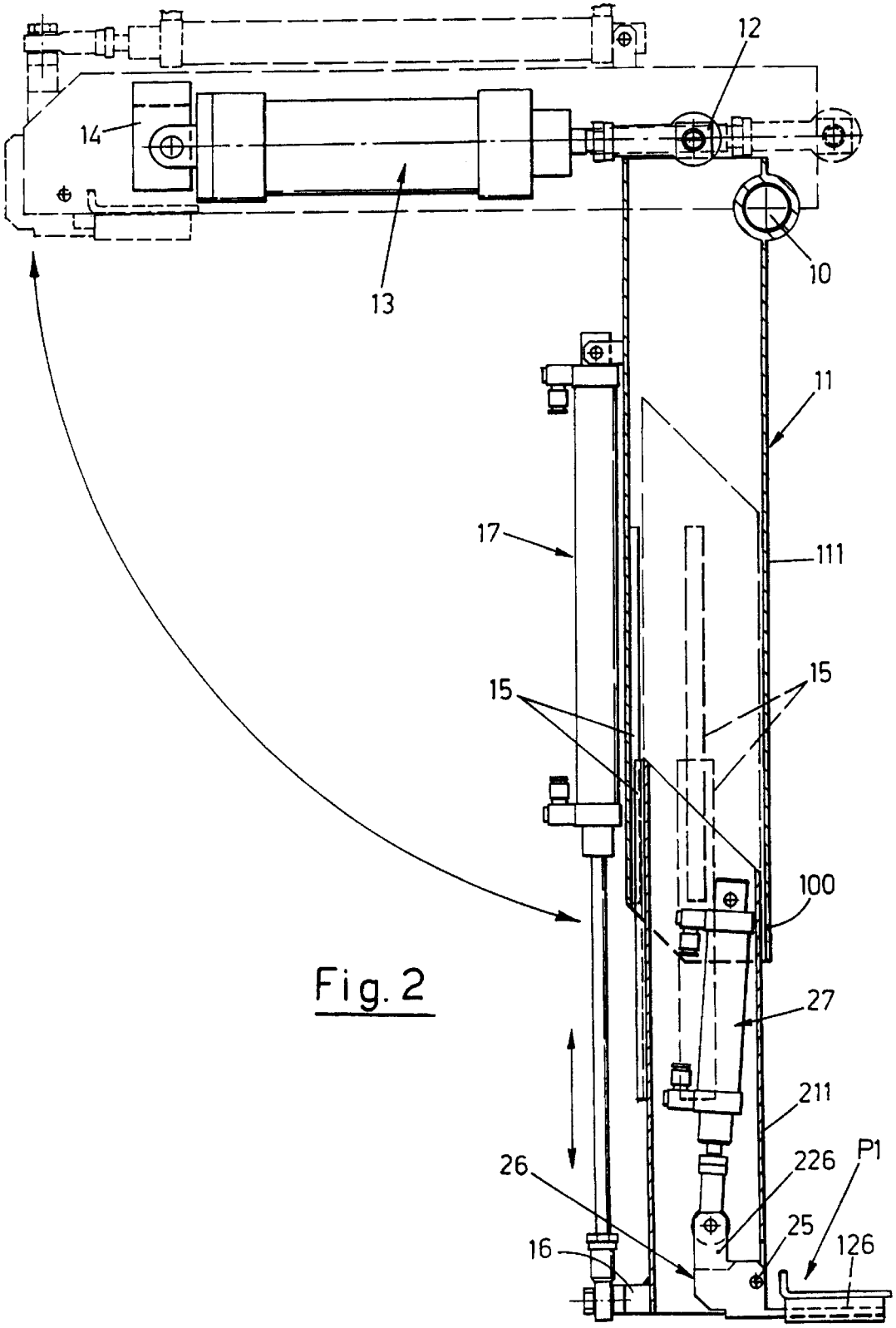
FIG. 2 shows a side view with sectioned parts of the main clamp.

The arm 11 is composed of a body 111 within which an inner member 11 slidably is mounted by means of guide-slide assemblies 15 (FIG. 2) whose lower end is provided with an appendage 16 linked to the stem of a pneumatic cylinder 17 fulcrum-attached to body 111. Upon operating cylinder 17, arm 11 can change from the condition wherein sliding inner member 211 is retracted within body 111 to the condition wherein it extends as shown in FIGS. 1 and 2. The sliding inner member 211 is less wide than body 111 so that a portion of such body 111, which is opposite the side towards the rotation orbit of the film reel, is free for all its entire height and a small arm 118 perpendicular to inner member 211 can move within it.

Figure 4:
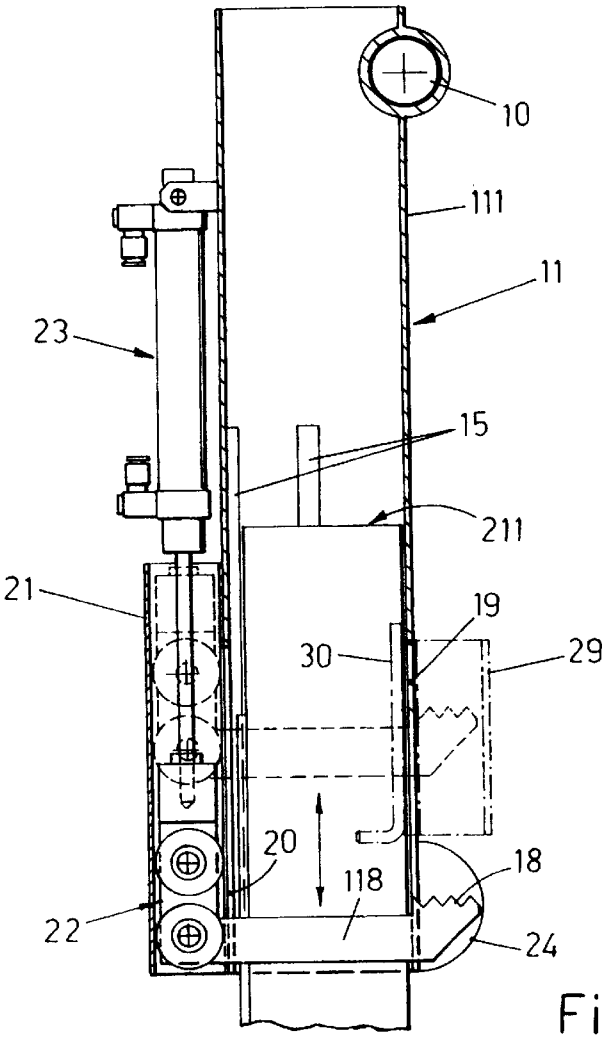
FIG. 4 shows a side view with sectioned parts of the film cutting assembly mounted to said main clamp.

An end of said fulcrum pin 10 is provided with a preferably saw-toothed blade 18 protruding from a longitudinal slit 19 cut in the lower wall of said body 111 which is turned downward when arm 11 is at rest in a horizontal position. The other end of said small arm 118 goes through a similar slit 20 cut in the opposite wall of said body 111 and of a tubular guide bar 21 fixed to said body, and is attached to a carriage 22 linked to the stem of a pneumatic cylinder 23 placed to the side of cylinder 17 and fulcrum-attached to body 111. When the apparatus is at rest, blade 1 rests at the lower end of body 111, as shown in FIG. 4 with a solid line, the same blade being hidden within a domed protection cap shown in FIGS. 3 and 4. Upon operating cylinder 23, blade 18 lifts and takes the position shown in FIG. 4 with a dashed line.

Articulated with a pin 25 on the free end of sliding inner member 211 and parallel to fulcrum pin 10 is a bell crank 26 which through one of its arms 126 protrudes from the wall of the inner sliding member turned towards blade 18. Through the other arm 226, within the inner sliding member itself, it is articulated to the stem of a pneumatic cylinder 27 fulcrum-attached within the inner sliding member 11 itself. Upon operating cylinder 27, bell crank 26 moves from the position shown in FIGS. 2 and 3 with a solid line to the position shown with a dashed line. The outer arm or jaw 126 of bell crank 26 forms the main part of the movable jaw of the main clamp P1 holding the wrapping film. For this reason, its active surface is coated with a strip 28 of an elastomeric material characterized by a high friction factor in respect of the film. Fixed to the opposite side of arm or jaw 126 is a small U-shaped case 29 on which fixed to its sides are suitably shaped metal rods 30 and 31 described hereinafter.

As shown in FIG. 1, provided on the intermediate part of carrier 1 are grooved rollers with a vertical axis 2 which slidably support, transversally to the carriage itself, a slide 33. The end of slide 33 turned towards the load to be wrapped supports the upper end of an L-shaped support 34 linked to the stem of a pneumatic cylinder 35, parallel to said slide, and the body of slide 33 is fixed to a bracket 36 attached to carrier 1. Vertically fixed to the foot of support 34 is the body of a pneumatic cylinder 37 whose stem is downward-oriented and which stem supports the body of a pneumatically-operated and self-centering clamp 38 whose jaws are downward-oriented. Said clamp 38 is partly protected by a special case 39 fixed to the body of the clamp and to which a vertical upward-oriented rod cooperating with a guide bar 41 fixed to said support 34 is attached so as to form a system preventing the said secondary clamp P2 from rotating. Said secondary clamp P2 is suitably oriented as described hereinafter, and when the apparatus is at rest it is opened, lifted and placed backward in respect of carrier 1.

Finally, as shown in FIG. 1, one can see that to the side of secondary clamp P2 and farther from main clamp P1, fixed to carrier 1 is the upper end of an L-shaped support 42 which extends downward and whose base supports the body of a pneumatic cylinder 43 wherein the stem 143 is downward-oriented and the free end thereof is suitably rounded. Laterally articulated by pin 44 on the base of said support 42, on the side opposite the one turned towards the secondary clamp P2, is a preferably round-sectioned lever 45 with a rounded fee end. Lever 45 is provided with an intermediate appendage 145 articulated to the stem of a pneumatic fluid-pressured and double-action cylinder 46 fulcrum-attached to the body of carrier 1. Provided on the base of said support 42, on the side opposite the one engaged by said lever 45, is a downward-oriented nozzle 47 connected to a source (not shown) which, once operated, feeds compressed air. When the apparatus is at rest, stem 143 is lifted, as is lever 45, and nozzle 47 is inactive.

Figure 5:
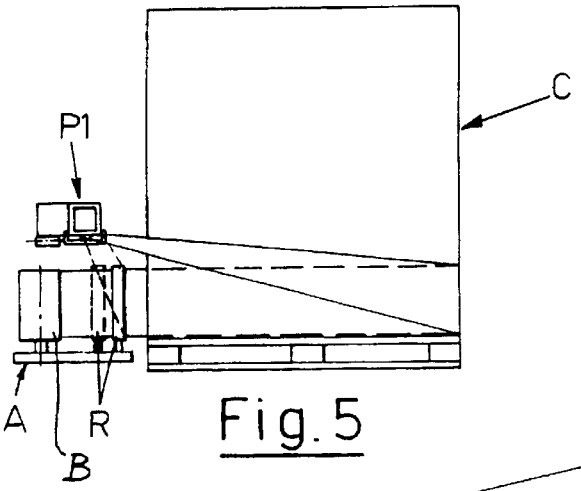
FIG. 5 shows a schematic side view of the position of the main clamp, the film reel with the pre-stretched and load film rolls at the beginning of a wrapping cycle.
Figure 6:
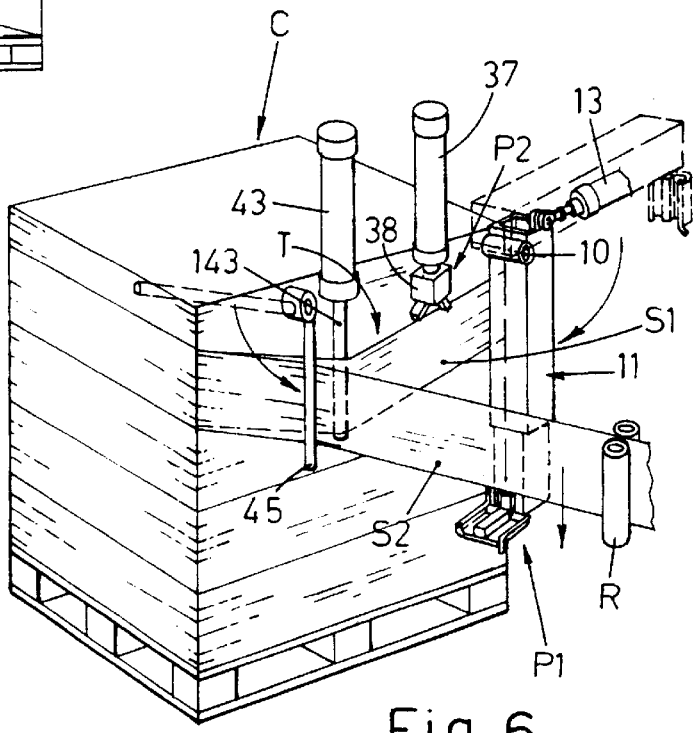
FIGS. 6, 7, 8, 9, 10, 11, 12, 13 show perspective views of as many corresponding subsequent phases of a working cycle of the apparatus.

At the beginning of a wrapping cycle, the film leading end unwound by reel B and fed by the pre-stretched film rolls R (FIG. 5) is fixed to main clamp P1 whose arm 11 is positioned backward and lifted, and the entire apparatus is positioned farthest from the load C to be wrapped. The carriage A with reel B and the pre-stretched film rolls R turn around load C to be wrapped, underneath clamp P1, so that the wrapping film leading end is surmounted by the first turns of the wrapping, and once said leading end is fastened, clamp P1 opens.

Once the load has been wrapped, carrier 1, rightly phased, approaches load C so as to be at the right distance from the load itself and such condition will be, for instance, recorded by special optoelectronic sensors or electromechanical tracer points, not shown. Subsequently cylinder 43 will be activated to lower stem 143 thereof so as to have at least the final wrapping turn SI surmount said stem 143, the length of film that touches it being at the right distance from the load and forming a pocket T adequately wider than the plan dimensions f the secondary clamp P2 assembly.

As a further step of the process, carriage A of the wrapping machine will stop in a predetermined angular position in respect of the apparatus at issue and such as, after cylinder 46 has been activated to lower counter-lever 45 and said lever has to taken a portion of the film tail S2 close to stem 143, the length of film between said parts 143–45 and carriage A is safely positioned on the gripping path of clamps P1 and P2 of the apparatus. Depending on the size of the load to be wrapped and it being understood that carriage A stops in an angular position at the end of the cycle, counter-lever 45 acts to align and position the film tail S2 correctly in respect of clamps P1 and P2.

As a next step, cylinder 13 will be activated to draw arm 11 of main clamp P1 to a vertical position, while said arm extends and said clamp opens. Following such movement, arm 11 will dispose itself laterally and at short distance from the film tail S2, underneath which the movable and open jaw 126, 28–31 of same clamp P1 will draw.

Figure 7:
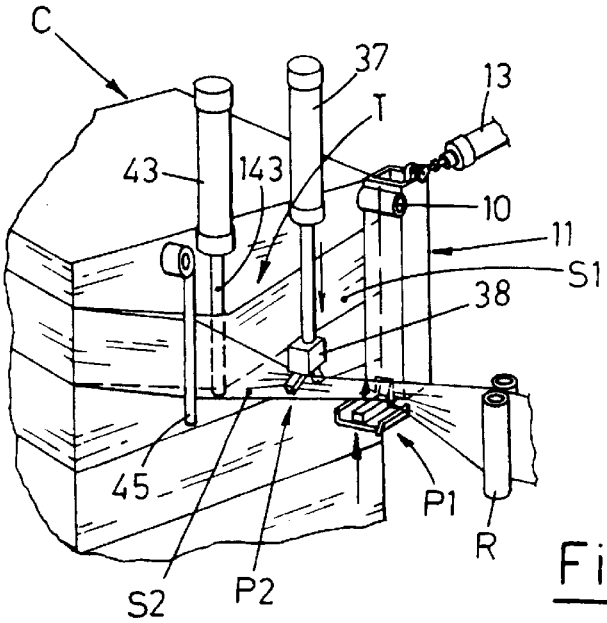
Figure 8:
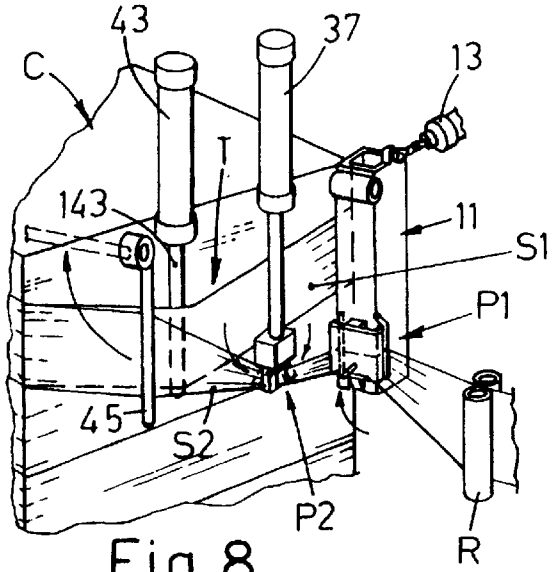

Subsequently, sliding inner member 211 of arm 11 of clamp P1 will be operated and lifted and consequently the movable jaw of said clamp will lift; the secondary clamp P2 will also be operated and lowered so that the film tail S2 placed between these clamps can be bundled by the jaws of said clamp P2, as shown in FIG. 7, and transversally gripped by said clamps. At this point, the jaws of clamps P1–P2 will be operated and closed, as shown in FIG. 8. Properly phased, then, counter-lever 45 goes back to the upper position, at rest.

Figure 3:
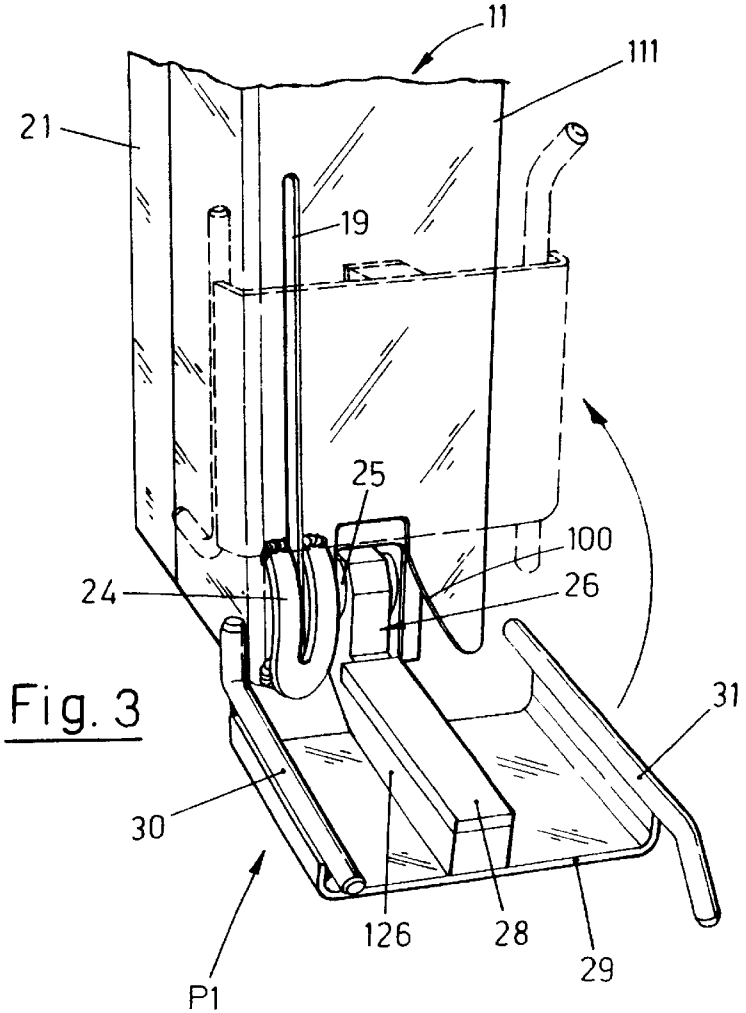
FIG. 3 shows the perspective of the end part of the main clamp.
Figure 9:
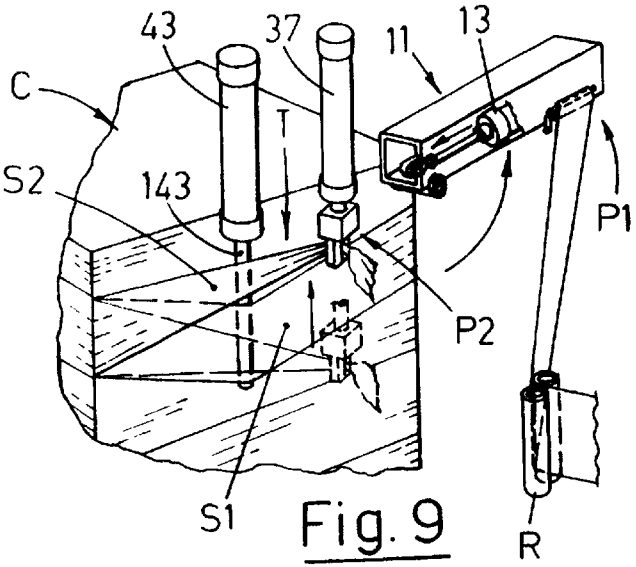
Figure 10:
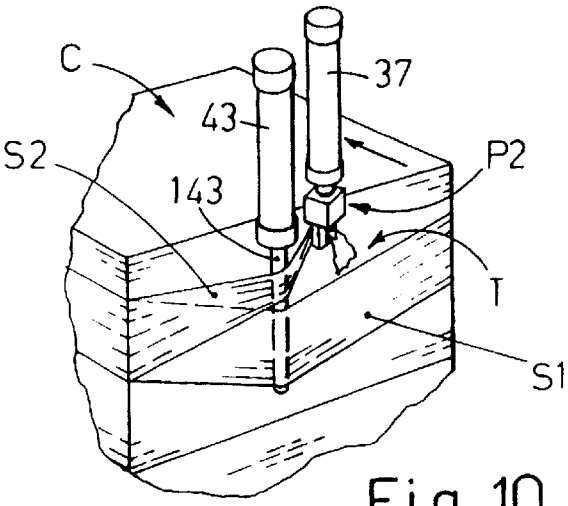

From the details of FIG. 3, showing main clamp P1, one can see that when sliding inner member 211 has been lifted; movable jaw 126 disposes itself at an end recess 100 of body 111 and when said jaw 126 closes, the film will be gripped by it on the wall of body 111 from which blade 18 is protruding. Thanks to the "L" shape of rod 30 fitted on movable jaw 126, the film gripped by clamp P1 is taken above the guards 24 of blade 18 and the film, properly stretched, disposes itself in front of slit 19. When subsequently cylinder 23 is operated and activated, the length of the film between the jaw of clamp P1 and the jaw of clamp P2 is cut by blade 18 which lifts and then lowers at rest. Rods 30 and 31, owing to their round sections, also act to prevent the film, interfering with clamp P1, from tearing. In this way the tail S2 of the completed wrapping will be held by clamp P2 and the film leading end coming from the wrapping machine carriage will be held by the jaw of clamp P1 whose arm 11 subsequently lifts to a horizontal position, as shown in FIG. 9, while secondary clamp P2 also lifts and translates by means of cylinder 35 to approach the load and center it with respect of pocket T formed in the final turn SI by stem 143 as shown in FIG. 10.

Figure 12:
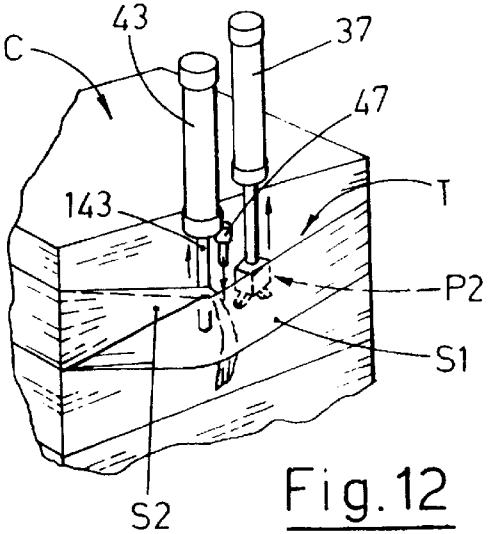
Figure 13:
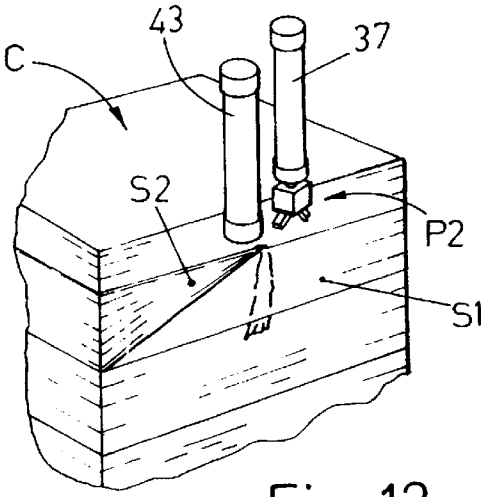
Figure 11:
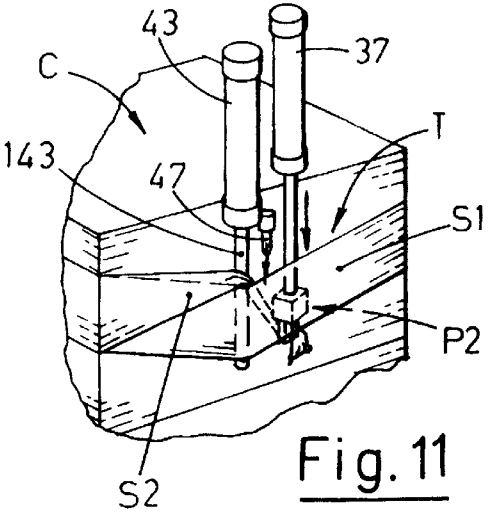

Properly phased is then activated nozzle 47 which blows a descending air jet at the right pressure into pocket T, while secondary clamp P2 is lowered and inserted into said pocket T, as shown in FIG. 11. After that, said clamp P2 opens and while the wrapping film tail S2 remains within pocket T because of the action exerted by the air jet, clamp P2 and stem 143, properly phased, are both lifted to the position at rest. Owing to the elasticity of the pre-stretched film wrapping load C, the film that formed said pocket T shrinks flat and grips the tail S2 of the wrapping itself, friction-blocking it within turn S1, as shown in FIGS. 12 and 13. The guard 39 prevents secondary clamp P2 from interfering with the film while it is being inserted into and then drawn out the pocket T of the wrapping. Subsequently, clamp P2 is retracted and is taken near carrier 1 which automatically moves away from the wrapped load and returns to the position at rest useful to repeating a new wrapping cycle, as seen in the first phase of FIG. 5.

Figure 14:
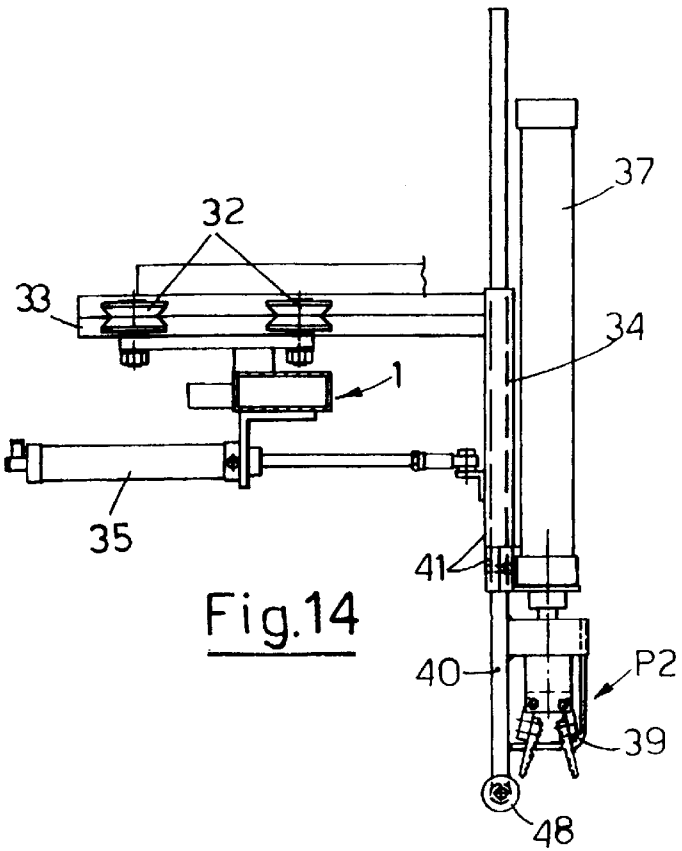
FIG. 14 is a side elevation view of another embodiment of the secondary clamp.

According to another embodiment of the invention, as shown in FIG. 14, the rod 40 which prevents the rotation of the secondary clamp P2, is arranged on the side of the said clamp which is opposite to the one directed towards the load C to be wrapped. The said rod 40 is dimensioned in its length so as to project suitably under the jaws of the said secondary clamp, the lower end of said rod being integral with the protection member 39 of the clamp P2, and being provided with rotatable and projecting rollers 48, the axis of which is substantially parallel to the carrier 1.

Figure 15:
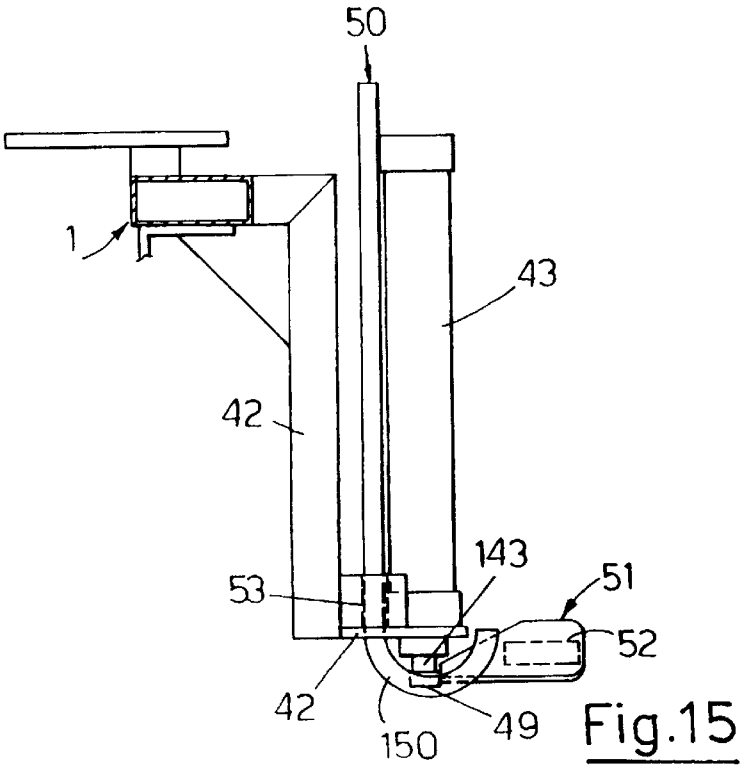
FIG. 15 is a side elevation view of another embodiment of the means for forming a pocket in the turns of the wrapping.
Figure 16:
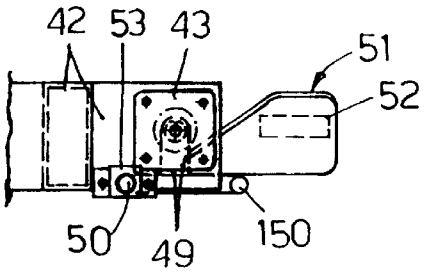
FIG. 16 is a top view of the means of FIG. 15.

According to a further embodiment of the invention, as illustrated in FIGS. 15 and 16, the stem 143 of the vertical cylinder 43 is employed for moving other means from those described with reference to FIGS. 1,11 and 12 for the formation of the pocket T in the wrapping, by eliminating the requirement of the nozzle 7. The said nozzle 47 is eliminated and to the lower end of the stem 143 there is secured in an overhanging manner a small plate 49 which is parallel to the carrier 1 and integral to the lower and rounded end of a rod 50 parallel to the said stem 143 and cooperating with a guide 53 fixed onto the base of the support 42 which carries cylinder 43. The rounded portion 150, obtained for example by bending the rod 50, is directed towards the load to be wrapped and carries, secured on the side opposite to the one directed towards the secondary clamp P2, a metallic blade 51. Blade 51 is substantially shaped as a rectangular trapezoid, with rounded edges and corners and with the greater base directed downwards is of such a length so as to project by an ample portion beyond the rounded portion 150, in the direction of the load C; and is also inclined in transverse direction and provided on its downwardly directed side with a rubber insert 52, for the reasons which will be explained hereafter.

Figure 18:
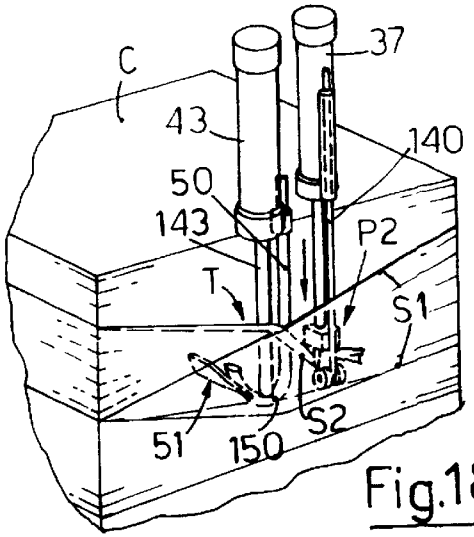
FIGS. 17, 18, 19, 20, 21 and 22 show in perspective view as many corresponding steps of a working cycle adopting the means shown in FIGS. 14, 15 and 16.
Figure 17:
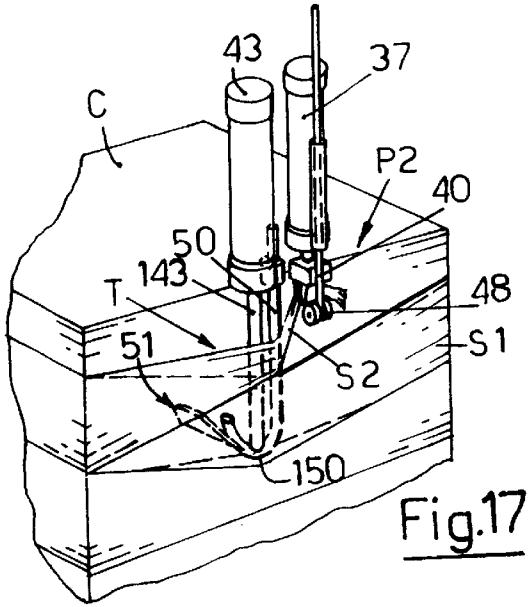

The parts described with reference to FIGS. 14, 15 and 16 operate in the following manner. The working cycle of the apparatus is the same as previously described in connection with FIGS. 8, 9 and 10, with the tail S2 of the wrapping which is held by the secondary clamp P2, with the only difference that pocket T of the said wrapping is now created by the assembly of stem 143, rod 50, rounded portion 150, and blade 51 lowered in its active condition by cylinder 43, as illustrated in FIG. 17. From FIGS. 17 and 18 it appears that the clamp P2 together with the tail S2 of the wrapping, is lifted as in the previous solution, thereafter moved over the pocket T and then lowered in the said pocket.

Figure 19:
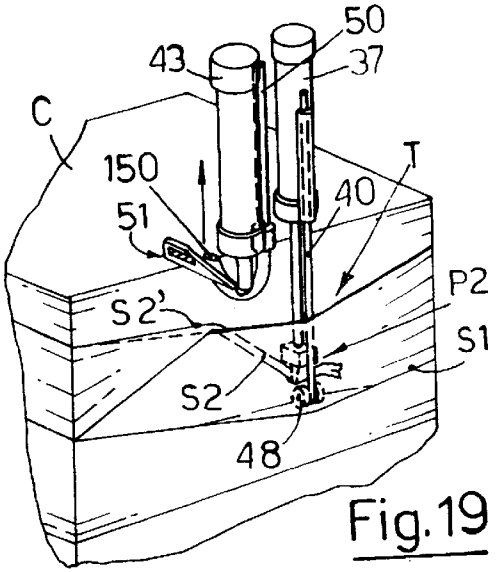

Subsequently, as illustrated in FIG. 19, the cylinder 43 lifts the assembly of rod 50, rounded portion 150, and blade 51, whereby the film forming the pocket bears against the rod 40 and lower roller 48 of the clamp P2 and the portion of the tail S2 which bears on the turn SI forming the pocket T comes to be arranged below the section of the blade 51 projecting out of the curved and lower portion 150 of the assembly which previously had formed the pocket itself. Thereafter, cylinder 43 again lowers the assembly of rod 50, rounded portion 150 and blade 51 for such a length that the blade 51 pushes onto the portion S2 of the tail S2 which bears on the upper edge of the turn S1 so as to frictionally lock the two parts between each other, also thanks to the presence of the rubber insert 52.

Figure 21:
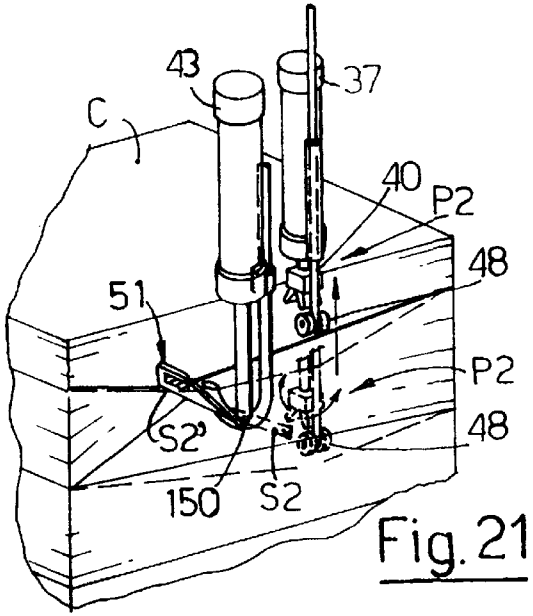
Figure 22:
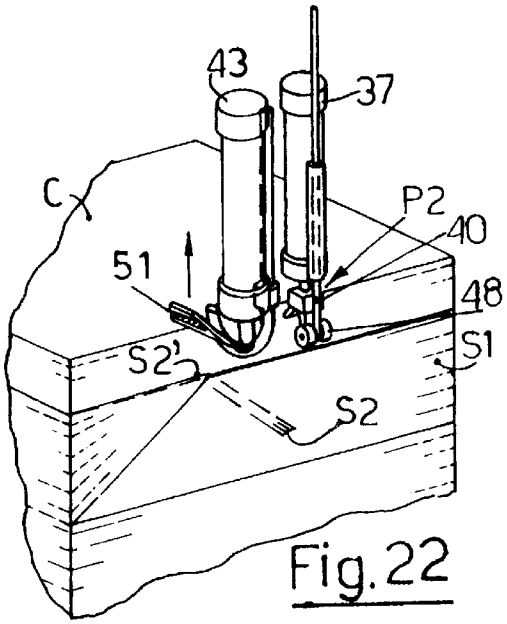
Figure 20:
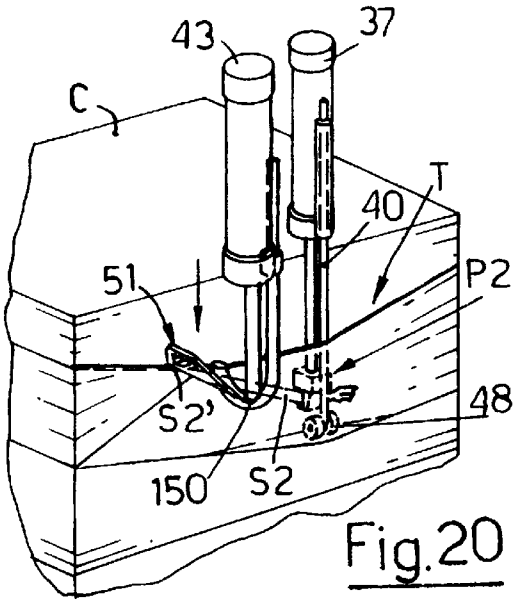

Subsequently, as illustrated in FIG. 21, the clamp P2 is opened and lifted out of the pocket T so as to abandon inside same the wrapping tail S2 which remains in the position in which it was abandoned, because it is held in the said position by the blade 51 and also because it is held almost immediately and progressively by the film forming the pocket T, which due to its elastic memory shrinks to a flat position against the load as soon as the clamp P2 has cleared out of the pocket. When the clamp P2 has been extracted, as shown in FIG. 22, the cylinder 43 lifts to its rest position the assembly of stem 143, rod 50, rounded portion 150, blade 51 and the pocket T of the wrapping definitively is closed also in its upper section. The apparatus is then ready for starting a new cycle.

What is claimed is:

1. A method for fastening a tail of a wrapping of plastic film for a wrapped palletized load comprising the steps of:

forming a pocket in at least one of final turns of a wrapping film of a wrapped load, said forming step including a longitudinal stretching of a portion of said at least one final turn causing said stretched portion to be arranged a predetermined distant from the wrapped load;

holding the wrapping film, in a zone outside of the pocket at which a wrapping tail of the wrapping film will be formed, with a main clamp and a secondary clamp;

cutting the wrapping film held between said main and secondary clamps so that the main clamp holds a film leading end for a wrapping cycle of a subsequent load, while the secondary clamp holds the wrapping tail of the wrapped load;

inserting the secondary clamp holding the wrapping tail into said pocket after said cutting step;

releasing of the wrapping tail by said secondary clamp inside said pocket;

drawing said secondary clamp out of the pocket; and allowing the pocket containing the wrapping tail to shrink flat against the wrapped load so that the then shrunk pocket grips and firmly holds said wrapping tail.

2. A method according to claim 1), wherein said holding step includes the step of transversely restricting the wrapping film in the zone between said main clamp and said secondary clamp to form a bundle.

3. A method according to claim 1), wherein said forming step includes the step of moving near to the load being wrapped a suitable distancing device on which a length of the wrapping film making up the final turns is then stretched over.

4. A method according to claim 1), wherein said releasing step includes the step of blowing an air jet into the pocket such that said air jet holds the wrapping tail in the pocket when said wrapping tail is released by the secondary clamp.

5. A method according to claim 1), further including after said inserting step the step of temporarily holding a portion of said wrapping tail against an introduction edge of the pocket so as to prevent said wrapping tail from slipping out of the pocket after the wrapping tail is released from the secondary clamp.

6. An apparatus for a fastening of a wrapping tail of a wrapping of plastic film for a palletized load, wherein a main carriage carries the wrapping film and said main carriage and said load are relatively rotated to effect wrapping of the load with the wrapping film, said apparatus comprising:

a forming means which, before final wrapping turns of a load are formed, is moved near the load for forming an open pocket as said final wrapping turns dispose themselves transversally on said forming means;

a drawing means for drawing a portion of said final wrapping turn at which a wrapping tail will be formed near said forming means;

a main clamp and an adjacent secondary clamp which grip said portion of said final wrapping turn outside of said pocket;

a cutting means for cutting the portion of the final wrapping turn between said main clamp and said secondary clamp outside of said pocket so that said main clamp holds a film leading end for a wrapping cycle of a subsequent load, while said secondary clamp holds the wrapping tail;

an inserting means for inserting the secondary clamp, which holds the wrapping tail free from said film leading edge, within said pocket;

an opening means for opening and then drawing the secondary clamp out of the pocket; and a withdrawing means for drawing out of the pocket the forming means so that the pocket shrinks owing to elastic features of the wrapping film and the wrapping tail is friction blocked in the final wrapping turns of the wrapping film.

7. An apparatus according to claim 6), further comprising:

a stopping means for stopping the main carriage carrying the wrapping film at a predetermined angular position relative to the load so that the wrapping tail running between the main carriage and the wrapped load is substantially tangent to said pocket;

a first moving means for initially moving the main clamp to a position where the main does not interfere with a movement of the main carriage;

a blowing means for blowing an air jet into the pocket to maintain the wrapping tail in the pocket;

a second moving means for moving the secondary clamp and the forming means from an active position back to a rest position.

8. An apparatus according to claim 6), wherein said main clamp, said secondary clamp, said forming means and said drawing means are mounted on a carrier which is oriented parallel to a handling line of consecutive loads to be wrapped; and further including a driving means for moving the main carriage with the wrapping film relative to said carrier; and wherein said carrier is equipped with a synchronization shaft which through end pinions co-operates with racks fixed to guide bars of the carriage, one end of which said carrier is linked to an alternate moving means for moving said carrier from a rest position to an active position.

9. An apparatus according to claim 6), wherein the forming means forming the pocket within the final wrapping turns comprises a vertically placed pneumatic cylinder having a body which is fixed to a support attached to the carrier, a stem of said cylinder being positioned downward and having a free end suitably rounded and said stem having such length that when said stem is extended near the load said stem disposes itself transversally to the wrapping film to hold a length of at least one final turn of the wrapping film so that the stem forms the pocket into which the wrapping tail will be inserted.

10. An apparatus according to claim 9), wherein, on said support bearing the cylinder whose stem forms the pocket there is articulated, perpendicularly to said cylinder, an end of a preferably round section counter-lever, said counter lever having a rounded free end and an intermediate portion linked to a second pneumatic cylinder having a body which is fulcrum-attached to the carrier, and wherein said second pneumatic cylinder normally has a stem thereof moved backward to keep said lever lifted and preferably slightly oriented upward relative to said carrier, while when the stem of said second pneumatic cylinder extends outward, the lever turns down and is disposed parallel to the stem of said first-mentioned pneumatic cylinder forming the pocket within the wrapping film.

11. An apparatus according to claim 9), wherein to said support holding the vertical cylinder whose stem forms the pocket there is mounted a downward-oriented air nozzle.

12. An apparatus according to claim 9), wherein laterally to the cylinder whose stem is provided for forming the pocket, on a side opposite to the one engaged by said counter-lever, there is arranged the secondary clamp comprising a guide-slide assembly mounted on the carrier, a slide of said slide-guide assembly being horizontal and perpendicular to the carrier and alternately activated by a second pneumatic cylinder which acts to move the secondary clamp from a position aligned to grasp the wrapping tail to a position closer to the load in order to insert the wrapping tail into the pocket created within the wrapping film, said slide bearing thereto a second support for a vertical body of a second pneumatic cylinder whose stem is downward-oriented and which said stem supports an operation mechanism of a self-centering clamp device having jaws which are downward-oriented and which said clamp device is partly surrounded by a guard having a function of preventing the clamp device from otherwise interfering with the wrapping film, said guard being attached to a lower end of a vertical and ascending rod which co-operates with a guide fixed to said second support to prevent the guard and the clamp device from rotating.

13. An apparatus according to claim 12), wherein laterally to the secondary clamp, on the side opposite the forming means forming the pocket within the wrapping film, there is provided the main clamp comprising a telescopic arm having an end fulcrum-attached to a vertical axis held by a third support fixed to the carrier, said telescopic arm extending beyond said fulcrum vertical axis through a side appendix articulated to a stem of a third pneumatic cylinder whose body is in turn attached to a fourth support fixed to said carrier as a projecting part, so that said telescopic arm, after said third pneumatic cylinder has been activated, moves from a vertical, downward position to a horizontal position, said telescopic arm being equipped with an inner sliding member whose lower end carries an end appendix linked to a stem of a fourth pneumatic cylinder whose body is attached to a body of the telescopic arm, wherein there is further provided transversally articulated to the lower end of said inner sliding member an intermediate portion of a bell crank which said bell crank by one arm thereof is placed within said inner sliding member and is linked to a fifth pneumatic cylinder attached to the inner sliding member, while the other lever arm of said bell crank protrudes from the inner sliding member on a side turned toward the portion of the wrapping film coming from the carriage, said lever arm forming a movable jaw of the main clamp and being normally perpendicular to the inner sliding member, such that when the main clamp is at rest, the telescopic arm is in a backward position and lifted, and said lever arm is open, while when the main clamp is clamping, said telescopic arm swings downward and at the same time extends so as to arrange itself laterally to the length of the wrapping film coming form the carriage and to place the movable lever arm underneath such the length of the wrapping film, and further including programming means for subsequently operating a lifting of the inner sliding member of said telescopic arm which through said movable jaw transversally bundles said wrapping film, said programming means also providing that subsequently said movable jaw partly engages a recess of a lower end of the body of the telescopic arm, and a lifting means is provided for lifting and closing said movable jaw.

14. An apparatus according to claim 13), wherein the movable jaw of the main clamp has a face in contact with the wrapping film which is lined with a suitable elastomeric film-frictional material, while fixed to an opposite face of the main clamp is a U-section case carrying on two opposite sides suitably shaped round rods.

15. An apparatus according to claim 14)

wherein the inner sliding member of the telescopic arm of the main clamp is less wide than the body of said telescopic arm, that the inner sliding member is slidably mounted within the body of the telescopic arm by a guide-slide assembly and said inner sliding member is such as to leave an inner portion of said body of said telescopic arm turned toward the secondary clamp free for an entire height thereof, wherein on a wall of said portion of the body of the telescopic arm which is turned toward the movable jaw of the main clamp there is provided a longitudinal slit from which a saw-toothed blade projects, said blade being attached to an arm which through an end carriage runs along a guide longitudinally fixed to said body of said telescopic arm and is actuated by a sixth pneumatic cylinder, provision being made that, when the carrier is at rest, said blade is surrounded by rounded guards attached to the lower end of the body of the telescopic arm, and wherein there is further provided a rod fixed to the side of the movable jaw of the main clamp next to said blade which is L-bent at an end close to the blade so that, when said movable jaw is closed, the wrapping film bundled by the jaw rests on said L-end of the rod which brings the bundle above said guards of the blade which said blade, when in operation, cuts the length of the wrapping film between said rod and the movable jaw.

16. An apparatus according to claim 6), further comprising:

blocking means for temporarily holding a portion of said wrapping tail blocked against an introduction edge of the pocket.

17. An apparatus according to claim 16), wherein said blocking means comprise a vertically movable blade element, said blade element being lined with high-friction material at least on a surface thereof intended to contact the wrapping tail.

18. An apparatus according to claim 17), wherein the blocking means are carried by a vertically movable rod forming part of the pocket forming means.

19. An apparatus according to claim 18), wherein the secondary clamp is provided, on a side oppose to a side facing the load, with a rod bearing against an inner side of the pocket when said secondary clamp is inserted in said pocket, a lower end of said rod projecting beyond a length greater than a length of the secondary clamp, and carrying at a free end at least one freely rotatable roller intended to contact an inner side surface of said pocket.

* * * * *